US007387283B2

(12) United States Patent
Franczyk

(10) Patent No.: US 7,387,283 B2
(45) Date of Patent: Jun. 17, 2008

(54) CUPCAKE STAND

(75) Inventor: Catherine Franczyk, Woodridge, IL (US)

(73) Assignee: Wilton Industries, Inc., Woodridge, IL (US)

( * ) Notice: Subject to any disclaimer, the term of this patent is extended or adjusted under 35 U.S.C. 154(b) by 112 days.

(21) Appl. No.: 11/484,113

(22) Filed: Jul. 11, 2006

(65) Prior Publication Data

US 2007/0023607 A1 Feb. 1, 2007

Related U.S. Application Data

(60) Provisional application No. 60/698,130, filed on Jul. 11, 2005.

(51) Int. Cl.
*A45D 19/04* (2006.01)

(52) U.S. Cl. ..... 248/175; 248/153; 211/181.1

(58) Field of Classification Search ..... 248/521, 248/165, 153, 175; 211/181.1, 126.9; 47/44, 47/41.01, 41.13, 47; D7/665–667; D6/405, D6/460, 474
See application file for complete search history.

(56) References Cited

U.S. PATENT DOCUMENTS 288,287 A * 11/1883 Whipple ..... 211/33
649,874 A * 5/1900 Payne ..... 47/41.11
1,892,393 A * 12/1932 Halm ..... 47/41.13
D97,712 S * 12/1935 Orben ..... D11/147
2,030,106 A * 2/1936 Fortes ..... 99/440
2,040,649 A * 5/1936 Fortes ..... 99/440
D112,347 S 11/1938 Nesbitt
D160,688 S 10/1950 Brock
D188,384 S * 7/1960 Messer ..... D11/147
4,240,603 A * 12/1980 Chiariello ..... 248/125.9
4,539,914 A * 9/1985 Lebecque ..... 108/94
4,583,955 A 4/1986 Toloczko
4,844,243 A 7/1989 Stiles
5,178,286 A * 1/1993 Allison, III ..... 211/85.23
D348,378 S 7/1994 Crane
5,413,801 A 5/1995 McIlwain
D422,456 S 4/2000 Krueger
6,517,035 B1 * 2/2003 Sellers ..... 248/146
D487,652 S * 3/2004 Reimonenq ..... D6/474

* cited by examiner

*Primary Examiner*—Korie Chan
(74) *Attorney, Agent, or Firm*—DLA Piper US LLP; R. Blake Johnston, Esq.

(57) ABSTRACT

A stand for holding and displaying a food item, such as a cupcake or muffin, includes a generally vertical trunk and at least one branch having an arm portion and a spiral portion with the arm portion connected to the trunk so that the branch extends radially outwards from the trunk. The spiral portion features coils sized to support the desert item. A base is attached to the trunk so that the stand may be supported on a generally horizontal surface. The inner coils of the spiral portion of the branch are bent downwards at an angle so that the food item is tipped for facilitated viewing.

11 Claims, 4 Drawing Sheets

CUPCAKE STAND

CLAIM OF PRIORITY

This application claims priority from U.S. Provisional Patent Application Ser. No. 60/698,130, filed Jul. 11, 2005.

FIELD OF THE INVENTION

The present invention relates generally to a holder for cupcakes, muffins and the like and, more particularly, to a decorative stand for displaying cupcakes, muffins and the like.

DETAILED DESCRIPTION OF EMBODIMENTS

Figure 1:
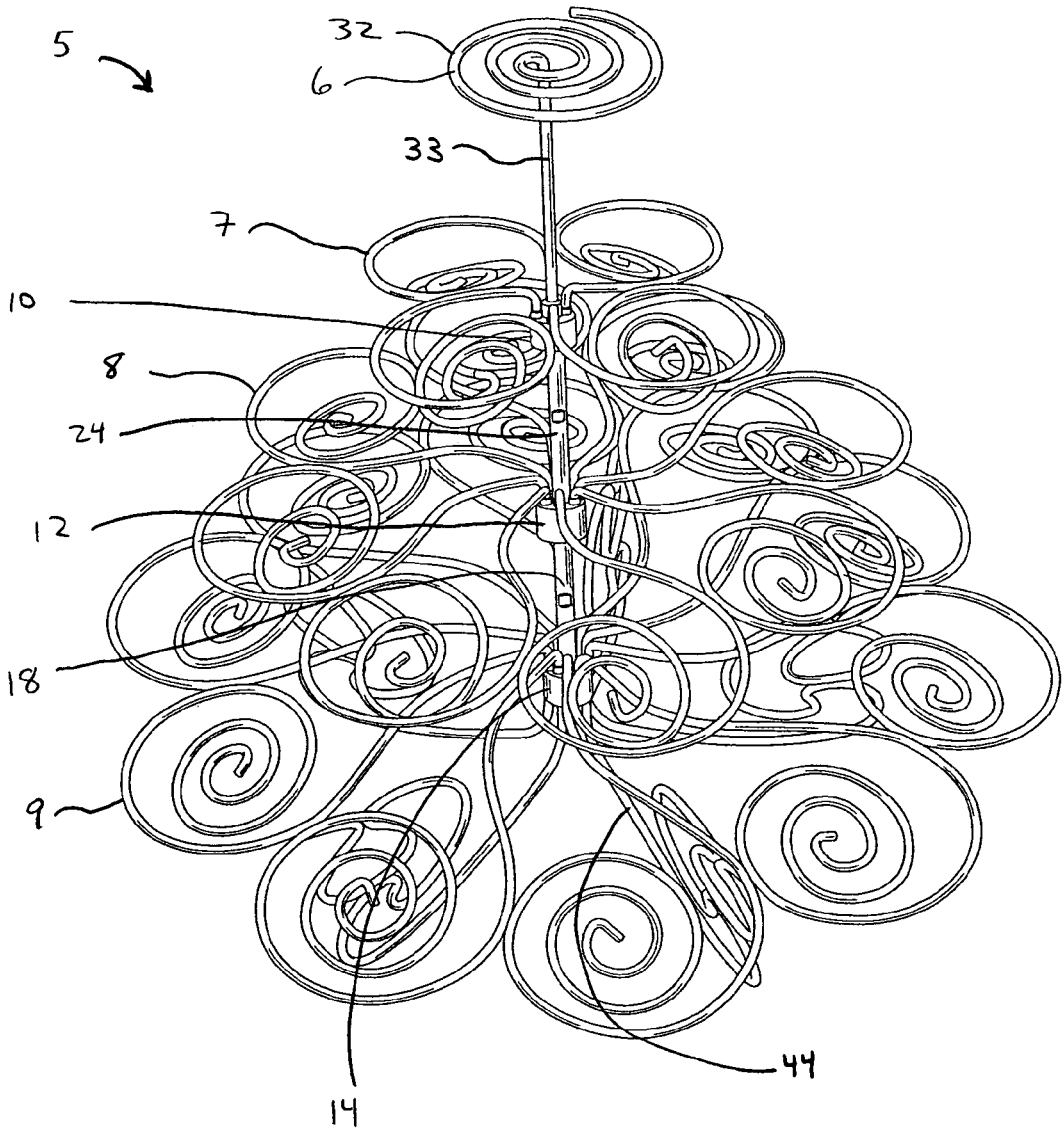
FIG. 1 is a perspective view of a first embodiment of the cupcake stand of the present invention.
Figure 2:
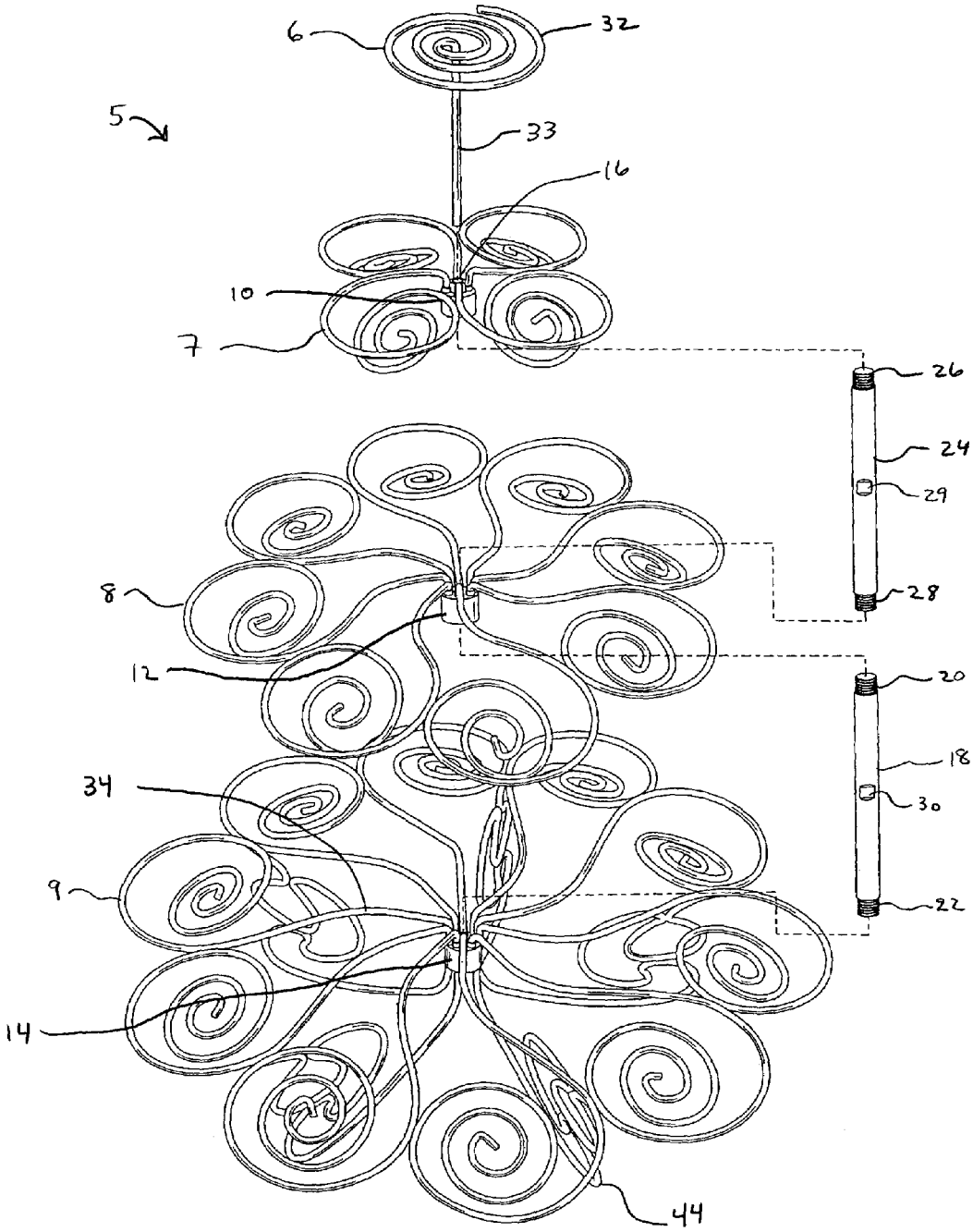
FIG. 2 is an exploded perspective view of the cupcake stand of FIG. 1.

An embodiment of the cupcake stand of the invention is indicated in general at 5 in FIGS. 1 and 2. As indicated in FIGS. 1 and 2, the cupcake stand 5 includes tiers 6, 7, 8 and 9. While the cupcake stand is described below in terms of holding cupcakes, it is to be understood that the stand could be used to hold other desert items or food items such as muffins.

Each of the bottom three tiers 7, 8 and 9 of the cupcake stand 5 features a central hub, illustrated at 10, 12 and 14, respectively, with a threaded bore formed therein (illustrated at 16 in FIG. 2 for hub 10). Each hub is preferably constructed from steel. A first vertical shaft 18 features threaded ends, illustrated at 20 and 22 in FIG. 2, that screw into the top portion of the bore of hub 14 and the bottom portion of the bore of hub 12. A second vertical shaft 24 features threaded ends 26 and 28 that screw into the top portion of the bore of hub 12 and the bottom portion of the bore of hub 10. As a result, the assembled shafts and hubs form a central, generally vertical trunk with tiers 7, 8 and 9 vertically spaced from one another.

Both shafts 18 and 24 are preferably constructed from steel. Each one of the shafts also preferably includes notches 29 and 30 so that the shaft may be engaged and turned by a small wrench or other tool for assembly of the stand. Shafts 18 and 24 could be replaced with a single, vertical shaft as the trunk in an alternative embodiment of the invention.

As illustrated in FIGS. 1 and 2, the three bottom tiers of the stand 7, 8 and 9 increase in horizontal diameter going from the top to the bottom of the stand. A single spiral holder 32 serves as the highest tier 6 of the stand and is positioned on the top end of a vertical shaft or wire 33 that engages the top portion of the bore 16 of hub 10.

Figure 3:
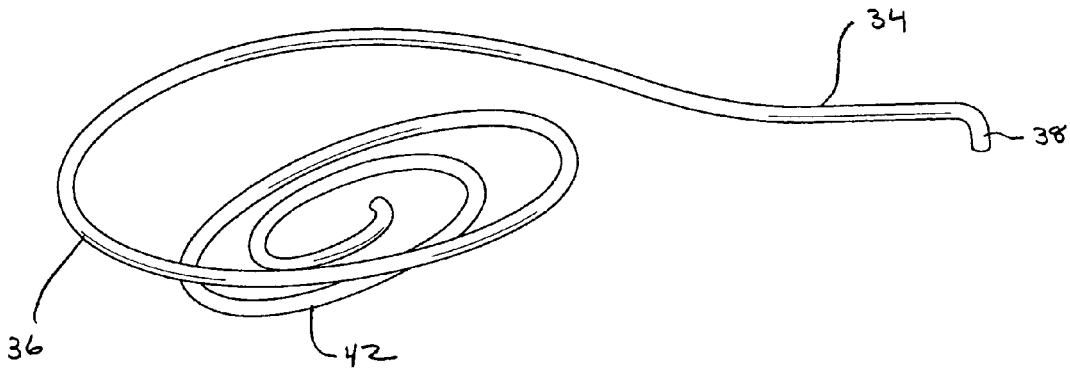
FIG. 3 is an enlarged perspective view of one of the branches of the cupcake stand of FIGS. 1 and 2.

Each of the three lower tiers features multiple branches constructed of wire. An enlarged view of one of the branches of the lowest tier is illustrated in FIG. 3. The wire is preferably steel and features an arm portion, illustrated at 34, and a spiral portion, illustrated at 36. The inner end 38 of the arm 34 is bent downwards and engages a corresponding opening in hub 14 (FIGS. 1 and 2). The end 38 is then preferably soldered in place. It should be noted, however, that alternative attachment arrangements known in the art may be used to attach the branches to the hubs. Multiple branches are connected to each hub in a circumferential fashion so that the branches extend in a radial fashion to form a tier. The spiral portions of adjacent branches may be soldered together in the manner illustrated in FIGS. 1 and 2 to enhance the structural rigidity of the stand.

As an alternative to the hubs, the branches could be attached directly to the trunk of the stand, that is, the vertical shafts 18 and 24 or a single, central vertical shaft.

As illustrated best in FIG. 3, the inner-most coils 42 of each spiral portion are preferably bent downwards at an angle so that the spiral forms a holder which may cradle a cupcake or similar food item. The inner coils 42 of the spiral holders are preferably bent with an angle that is oriented so that the top surfaces of cupcakes positioned therein are tipped outward for facilitated viewing.

As illustrated at 44 in FIGS. 1 and 2, a number of wire legs are also attached to the bottom side of hub 14, in a fashion similar to the way the branches are attached, to form a base so that the stand may be supported on a generally horizontal surface. The legs are preferably made of wire and may alternatively be attached directly to the trunk of the stand. The legs may be soldered to the branches of the above tier to increase structural rigidity of the stand. While the base of the stand of FIGS. 1 and 2 consists of a number of legs, it is to be understood that the base of the stand of the invention could take other forms including, but not limited to, a disc-shaped or conical-shaped base.

Figure 4:
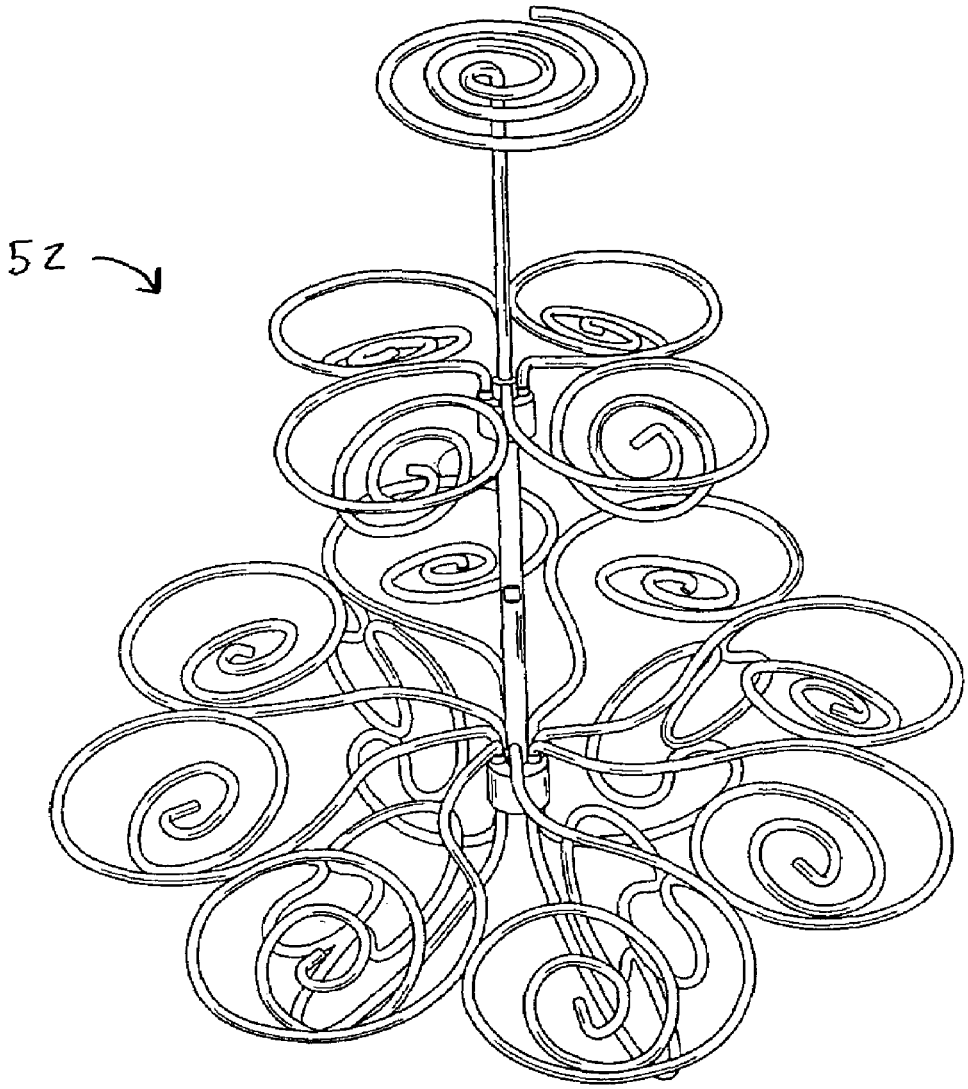
FIG. 4 is a perspective view of a second embodiment of the cupcake stand of the present invention.

While the embodiment illustrated in FIGS. 1 and 2 features four tiers and will hold twenty-three cupcakes, it is to be understood that the stand may feature an alternative number of tiers and may accommodate an alternative number of cupcakes or other food items. For example, the embodiment indicated in general at 52 in FIG. 4 accommodates thirteen cupcakes and features three tiers.

The present invention thus provides a stand that, when loaded with cupcakes or other food items, creates an attractive display which also offers easy access to the desert items.

While embodiments of the invention have been shown and described, it will be apparent to those skilled in the art that changes and modifications may be made therein without departing from the spirit of the invention.

What is claimed is:

1. A stand for holding and displaying a desert item having a generally flat bottom and a side, the stand comprising:

a. a generally vertical trunk;

b. a plurality of branches wherein each branch having an arm portion and a spiral portion with the arm portion connected to the trunk so that the branch extends radially outwards from the trunk;

c. each of said spiral portion including inner coils surrounded by an outer coil, said inner coils cooperatively forming a generally planar surface to support the generally flat bottom of the desert item with at least a portion of the outer coil adapted to engage the side of the desert item, the outer coil of said spiral portion secured to adjacent outer coil of adjacent spiral portion via securing means to enhance structural rigidity of the stand; and d. a base attached to the trunk so that the stand may be supported on a generally horizontal surface.

2. The stand of claim 1 wherein the branches are constructed from wire.

3. The stand of claim 1 wherein inner coils of the spiral portion of each of said branch is bent downwards at an angle so that the generally planar surface is tipped for facilitated viewing of the desert item.

4. The stand of claim 1 wherein the trunk includes a hub to which said branches are attached and a generally vertical shaft attached to the hub.

5. The stand of claim 4 wherein the hub includes a threaded bore and the generally vertical shaft includes a threaded end that engages the bore.

6. The stand of claim 5 wherein the vertical shaft includes notches so that the shaft may be engaged and turned by a small wrench for assembly of the stand.

7. The stand of claim 4 wherein the vertical shaft is made of steel.

8. The stand of claim 4 wherein the hub includes a bore and a spiral holder serves as a highest tier of the stand and is positioned on a top end of a vertical wire that engages the bore of the hub.

9. The stand of claim 1 wherein the base includes legs.

10. The stand of claim 9 wherein the legs are constructed of wire.

11. The stand of claim 1 wherein the plurality of branches are constructed from wire and the outer coils are secured together by soldering securing means.

* * * * *